US012016395B2

(12) United States Patent
Brazza

(10) Patent No.: US 12,016,395 B2
(45) Date of Patent: Jun. 25, 2024

(54) OXYGEN PRODUCING CARTRIDGE FOR VAPING APPARATUS

(71) Applicant: Caesar Brazza, Chatham, NJ (US)

(72) Inventor: Caesar Brazza, Chatham, NJ (US)

( * ) Notice: Subject to any disclaimer, the term of this patent is extended or adjusted under 35 U.S.C. 154(b) by 1458 days.

(21) Appl. No.: 16/396,840

(22) Filed: Apr. 29, 2019

(65) Prior Publication Data

US 2019/0335810 A1 Nov. 7, 2019

Related U.S. Application Data

(60) Provisional application No. 62/667,428, filed on May 5, 2018.

(51) Int. Cl.

| | |
|---|---|
| ***A24F 47/00*** | (2020.01) |
| ***A24F 40/30*** | (2020.01) |
| ***A24F 40/42*** | (2020.01) |
| ***A24F 40/50*** | (2020.01) |
| *A24F 40/10* | (2020.01) |
| *A24F 40/20* | (2020.01) |

(52) U.S. Cl.

CPC ..... *A24F 40/50* (2020.01); *A24F 40/30* (2020.01); *A24F 40/42* (2020.01); *A24F 40/10* (2020.01); *A24F 40/20* (2020.01)

(58) Field of Classification Search

CPC ..... A24F 40/00; A24F 40/05; A24F 15/01; A24F 42/10; A24F 15/18; A24F 1/26; A61M 15/06; A61M 11/042; A61M 2205/8206

See application file for complete search history.

(56) References Cited

U.S. PATENT DOCUMENTS

| | | | | |
|---|---|---|---|---|
| 3,200,819 | A | 8/1965 | Gilbert | |
| 4,429,703 | A | 2/1984 | Haber | |
| 6,286,516 | B1 * | 9/2001 | Bowen | A24D 1/00 131/365 |
| 10,849,358 | B2 * | 12/2020 | Mishra | H05B 1/0297 |
| 2016/0120224 | A1 | 5/2016 | Mishra et al. | |
| 2018/0064168 | A1 * | 3/2018 | Hurwitz | A61M 11/042 |
| 2018/0154194 | A1 * | 6/2018 | Imbruce | C01B 13/0296 |
| 2019/0174833 | A1 * | 6/2019 | Shuster | A24F 7/00 |

OTHER PUBLICATIONS

Fazli Wahid et al., Recent Advances in Antimicrobial Hydrogels Containing Metal Ions and Metals/Metal Oxide Nanoparticles, Nov. 23, 2017, MDPI Open Access Journals (Year: 2017).*

* cited by examiner

*Primary Examiner* — Eric Yaary
(74) *Attorney, Agent, or Firm* — Gearhart Law, LLC

(57) ABSTRACT

An e-vaping apparatus is described. The e-vaping apparatus includes a heater component. The e-vaping apparatus also includes a cartridge with a channel. The channel is filled with an oxygen producing component. The oxygen producing component is configured to release a vapor upon being heated by the heater component. The vapor includes oxygen.

18 Claims, 3 Drawing Sheets

OXYGEN PRODUCING CARTRIDGE FOR VAPING APPARATUS

CLAIM OF PRIORITY

This application claims priority to U.S. Application Ser. No. 62/667,428 filed on May 5, 2018, the contents of which are herein incorporated by reference in its entirety.

FIELD OF THE EMBODIMENTS

The field of embodiments of the present invention related to an oxygen producing cartridge for a vaping apparatus.

BACKGROUND OF THE EMBODIMENTS

Electronic vaping devices provide a smokeless alternative to cigarettes or similar products that work by burning tobacco products. Tobacco based cigarettes or similar products have long been known to cause diseases. Smokeless non-tobacco cigarettes aid to provide a safe and harmless alternative to smoking by replacing burning tobacco and paper to inhale smoke with inhalation of heated, moist, and/or flavored air.

For instance, U.S. Pat. No. 3,200,819A pertains to a smokeless non-tobacco cigarette that allows the user to smoke either air or medicine instead of tobacco. These cigarettes provide a smokeless non-tobacco cigarette by circulating fluid around a heating element in a turbulent manner to raise the temperature of the inhalant mixture which creates air that approximates that of cigarette smoke. Gilbert states that his smokeless cigarette uses "flavoring preparation" and "moisture" to replace cigarette smoke.

U.S. Pat. No. 4,429,703A pertains to a cigarette substitute which has the appearance of a cigarette which uses an aromatic substance to simulate cigarette smoke.

U.S. Pub. 2016/0120224A1 pertains to an e-vaping cartridge to be used in an e-vaping device. The device draws air through the cartridge. The air is drawn through the cartridge and may absorb flavor.

However, none of the art described above addresses all the issues that the embodiments of the present invention do.

SUMMARY OF THE EMBODIMENTS

Embodiments of the present invention include an e-vaping apparatus. The e-vaping apparatus include a heater component and a cartridge. The cartridge may also include a channel. The channel may include an oxygen producing component. The oxygen producing component may be configured to release a vapor upon being heated by the heater component. The vapor may include oxygen.

Embodiments also include an e-vaping apparatus. The e-vaping apparatus may include a heater component and a cartridge. The cartridge may include a channel. The channel may include a pre-vapor composition and an oxygen producing component. The pre-vapor composition may be configured to release a vapor upon being heated by the heater component. The oxygen producing component may be configured to release oxygen that mixes with the vapor upon being heated by the heater component.

A method of providing oxygen in a vapor produced by an e-vaping apparatus is also described. The method may include detecting an inhalation action by a user. Turning on a heater component to heat a channel within a cartridge. The channel may include a pre-vapor composition and an oxygen producing component. A vapor may be produced in response to an application of heat by the heater on the pre-vapor composition. Next, oxygen may be released into the vapor in response to the application of heat by the heater on the oxygen producing component. The vapor with oxygen may be routed to the user in response to the inhalation action.

It is an object of the embodiment of the present invention to provide an e-vaping apparatus capable of producing oxygen during use.

It is another object of the embodiment of the present invention to provide a cartridge with a pre-vapor composition and an oxygen producing component.

It is another object of the embodiment of the present invention to release a vapor from the pre-vapor composition upon application of heat by a heater component.

It is yet another object of the embodiment to release oxygen to the vapor upon heating the oxygen producing component with the heater component.

In addition to the foregoing, other objects, features, aspects and advantages of the present invention will be better comprehended through a careful reading of a detailed description provided herein below with appropriate reference to the accompanying drawings.

DESCRIPTION OF THE PREFERRED EMBODIMENTS

Figure 1:
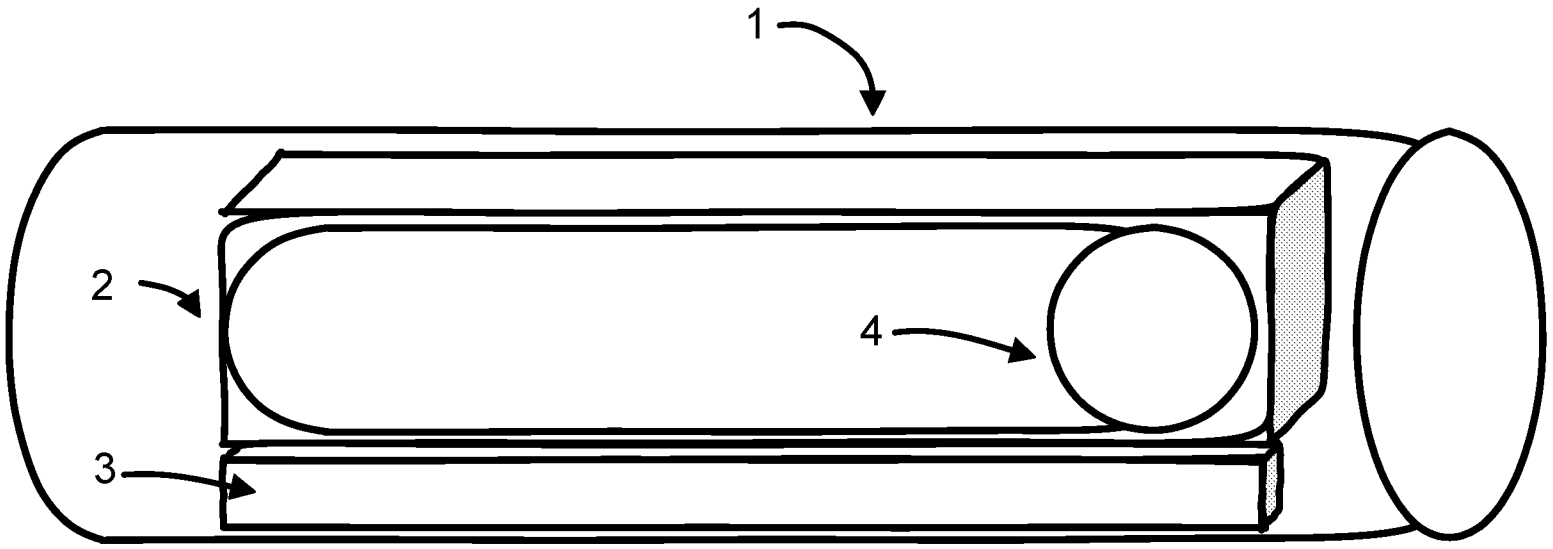
FIG. 1 shows a component view of the e-vaping apparatus.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As seen in FIG. 1 the present invention may include a e-vaping apparatus 1. The e-vaping apparatus 1 may include an electronic cigarette or similar device that includes a heater component 3 configured to heat an oxygen producing component 4 and release a vapor to a user.

The e-vaping apparatus 1 may include a cartridge 2. The cartridge 2 may include consumable material that may be heated to generate a vapor for an inhalation by the user. In an example scenario, the cartridge 2 may include an oxygen generating component 4. For example, the oxygen generating component 4 may include one or more chemicals that may produce a vapor. Upon an application of heat by the heater component 3, the oxygen producing component 4 may release the vapor. The vapor may include oxygen. As such, a user may inhale the vapor that includes higher concentrations of oxygen (compared to air) when utilizing the e-vaping apparatus 1.

In an example scenario, the heater component 3 may be configured to turn on in response to an inhalation event such as a suction action by a user. The heater component 3 may be configured to turn off in response to decrease in a force of the inhalation and/or a stop action associated with the inhalation.

Alternatively, the heater component 3 may automatically turn on or off in response to detection of an event such as an application of or a removal of touch based pressure or a temperature increase/decrease. For example, a touch pressure sensor on the e-vaping apparatus 1 may activate/deactivate the heater component 3 in response to detecting an application of or a removal of pressure by the lips of the user on the pressure sensor. In another example scenario, a heat sensor may activate/deactivate the heater component 3 in response to elevated ambient heat caused by proximity of the lips of the user or decreased ambient heat caused by loss of contact with the lips of the user.

In another example scenario, the heater component 3 may be activated manually by the user. The user may be provided with a control component on the e-vaping apparatus to activate/deactivate the heater component 3. The user may also be provided with a remote control component to activate/deactivate the heater component 3 remotely.

The heater component 3 may span a length of the cartridge 2 to uniformly heat the oxygen producing component 4. Alternatively, the heater component 3 may encompass a section of the oxygen producing component 4. The heater component 3 may adjust temperatures based on melting, vaporization, and/or chemical reaction demands associated with the oxygen producing component 4.

The heater component 3 may be powered by a battery component or similar power source. The battery component may be rechargeable. The battery component may also be resistant to any heat produced by the heater component 3 and may operate optimally regardless or the heat emitted by the heater component 3.

Figure 2:
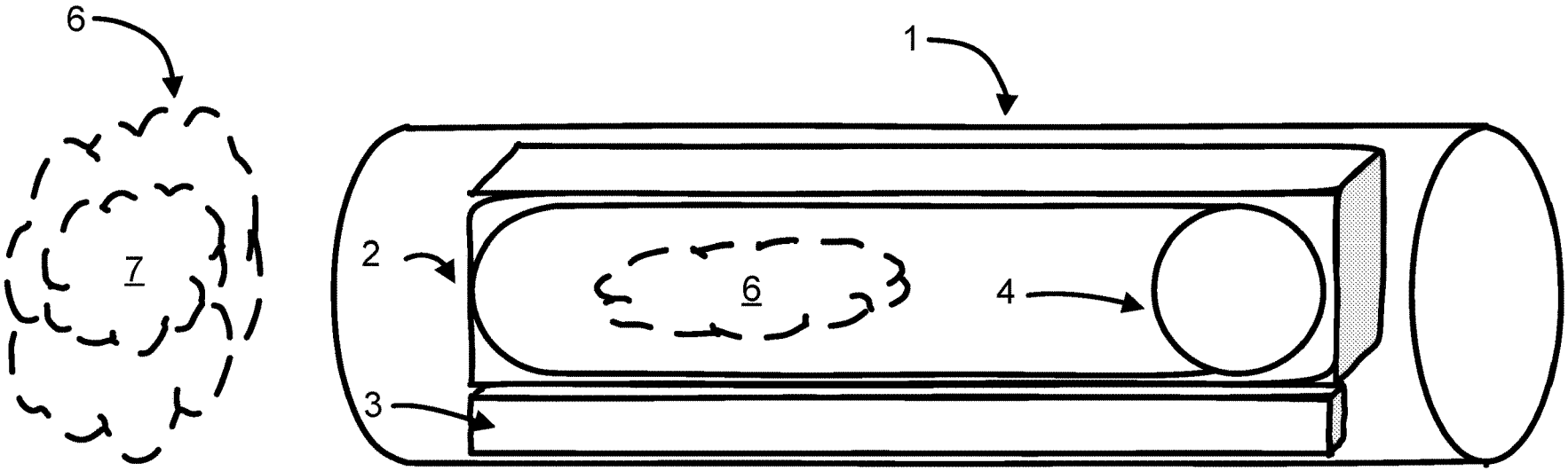
FIG. 2 shows a detailed view of a cartridge of the e-vaping apparatus.

FIG. 2 shows a detailed view of the cartridge 2 of the e-vaping apparatus 1. The cartridge 2 may encapsulate the oxygen generating component 4 within a channel. The channel may include a hollow section within the cartridge 2.

In an example scenario, the heater component 3 may heat the oxygen generating component 4 (in response to an activation event such an inhalation by the user). The oxygen generating component 4 may be melted, vaporized, and/or subjected to a chemical reaction to generate the vapor 6. The vapor 6 may include oxygen 7.

The oxygen producing component 4 may be a solid. The oxygen producing component 4 may be a liquid. In another example scenario, the oxygen producing component 4 may be partly solid and partly liquid.

The oxygen producing component 4 may also be a hydrogel. Furthermore, the oxygen producing component may be porous. The oxygen producing component may also include barium peroxide, potassium chlorate, potassium perchlorate, and/or sodium chlorate, among other chemicals.

In response to an application of heat by the heater component 2, the oxygen producing component 4 may melt, vaporize, and/or be subjected to a chemical reaction to produce the vapor 6. The vapor 6 may include the oxygen 7. The vapor 6 may be routed through the porous components of the oxygen producing component 4. Upon exiting the e-vaping apparatus 1, the vapor 6 with the oxygen 7 may be delivered to the user for an inhalation.

In an example scenario, the oxygen 7 may comprise at least 50% of the vapor 6 by weight. Preferably, the oxygen 7 may comprise 50% of the vapor 6 by weight.

Figure 3:
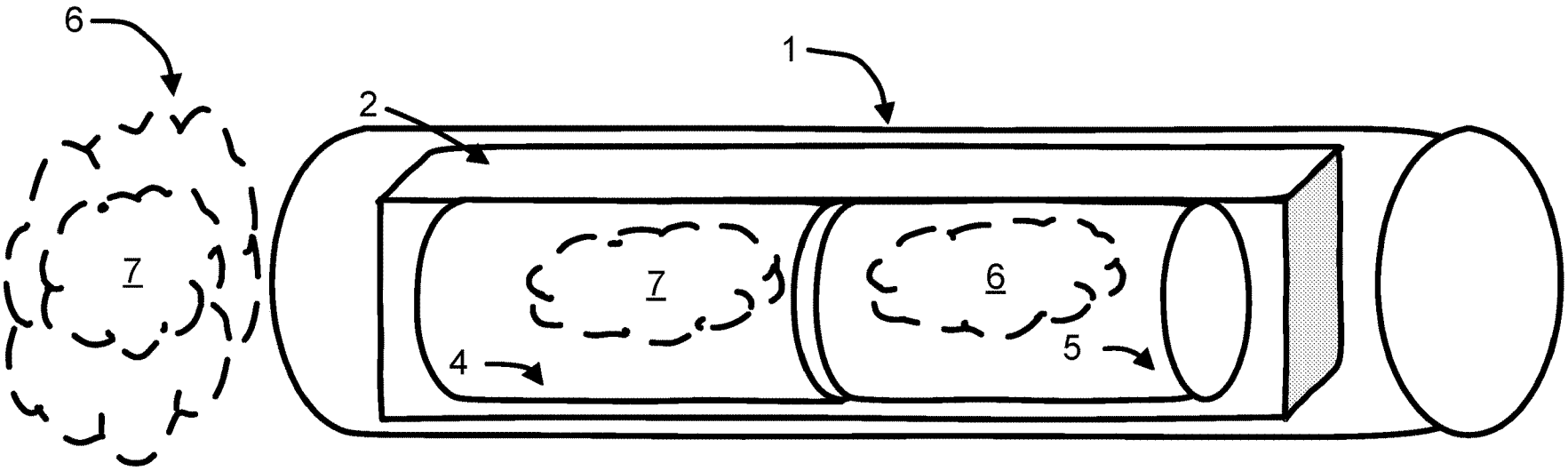
FIG. 3 shows a detailed view of another embodiment of the cartridge of the e-vaping apparatus.

FIG. 3 shows a detailed view of an alternative embodiment of the cartridge 2 of the e-vaping apparatus 1. The cartridge 2 may encapsulate a pre-vapor composition 5 and the oxygen producing component 4 within a channel. The channel may include a hollow section within the cartridge 2. The channel may encapsulate the pre-vapor composition 5 and the oxygen generating component 4. The pre-vapor composition 5 may be placed at a first end of the cartridge 2 in proximity to an air inlet of the e-vaping apparatus 1. The oxygen generating component 4 may be placed at a second end of the cartridge 2 in proximity to a vapor outlet of the e-vaping apparatus 1.

In an example scenario, the heater component 3 may heat the pre-vapor composition 5 (in response to an activation event such an inhalation by the user). The pre-vapor composition 5 may be melted, vaporized, and/or be subjected to a chemical reaction to produce the vapor 6. The vapor 6 may include chemicals such as nicotine, one or more flavor(s), and/or steam. The flavor(s) may be dependent based on a selection of the cartridge 2. Number of cartridges may be available and/or used within the e-vaping apparatus 1 that offer various mixes of flavor(s) and/or nicotine concentration(s) based on a selection by the user.

The pre-vapor composition 5 may be porous. The vapor 6 may transfer through the porous sections of the pre-vapor composition 5 into the oxygen producing component 4. The oxygen producing component 4 may also be porous. In response to an application of heat by the heater component 2, the oxygen producing component 4 may also melt, vaporize, and/or be subjected to a chemical reaction to produce oxygen 7. The oxygen 7 may be released and mixed into the vapor 6 that is routed through the porous components of the oxygen producing component 4. Upon exiting the e-vaping apparatus 1, the vapor 6 with the oxygen 7 may be delivered to the user for an inhalation.

Alternatively, a temperature of the vapor 6 may passively heat, melt/vaporize, and/or subject the oxygen producing component 4 to a chemical reaction. The temperature of the vapor 6 may cause the oxygen producing component 4 to generate oxygen without a direct application of heat by the heater 3. The generated oxygen 7 may be released into the vapor 6. Upon existing the e-vaping apparatus 1, the vapor 6 with the oxygen 7 may be delivered to the user for an inhalation.

The oxygen 7 may be released into the vapor 6 as the vapor 6 is routed through the cartridge 2. The vapor 6 with the oxygen 7 may be delivered to the user for an inhalation. The oxygen 7 may comprise at least 50% of the vapor 6 by weight. Preferably, the oxygen 7 may comprise 50% of the vapor 6 by weight.

A method of providing oxygen in a vapor produced by an e-vaping apparatus is also described. The method may include detecting an inhalation action by a user. Turning on a heater component to heat a channel within a cartridge. The channel may include a pre-vapor composition and an oxygen producing component. A vapor may be produced in response to an application of heat by the heater on the pre-vapor composition. Next, oxygen may be released into the vapor in response to the application of heat by the heater on the oxygen producing component. The vapor with oxygen may be routed to the user in response to the inhalation action.

In addition to the foregoing, other objects, features, aspects and advantages of the present invention will be better comprehended through a careful reading of a detailed description provided herein below with appropriate reference to the accompanying drawings.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. An e-vaping apparatus comprising:
a first end, a second end, and at least one sidewall,
wherein the first end comprises an outlet of the e-vapor apparatus;
a sensor configured to detect an inhalation event at the outlet of the e-vaping apparatus;
a heater component; and
a cartridge having both a pre-vapor composition and an oxygen producing component,
wherein the oxygen producing component is configured to release an oxygen containing vapor upon being heated by the heater component, wherein the oxygen containing vapor comprises at least 50% oxygen by weight, and
wherein the oxygen containing vapor is released from the outlet of the e-vaping apparatus in response to a detected inhalation event at the outlet.

2. The e-vaping apparatus of claim 1, wherein the oxygen producing component is a solid.

3. The e-vaping apparatus of claim 1, wherein the oxygen producing component is a liquid.

4. The e-vaping apparatus of claim 1, wherein the oxygen producing component is a hydrogel.

5. The e-vaping apparatus of claim 1, wherein the oxygen producing component is porous.

6. The e-vaping apparatus of claim 1, wherein the oxygen producing component includes one or more of barium peroxide, potassium chlorate, potassium perchlorate, or sodium chlorate.

7. An e-vaping apparatus comprising:
a first end, a second end, and at least one sidewall,
wherein the first end comprises an outlet of the e-vapor apparatus;
a sensor configured to detect an inhalation event at the outlet of the e-vaping apparatus;
a heater component; and
a cartridge having both a pre-vapor composition and an oxygen producing component,
wherein the pre-vapor composition is configured to release a vapor upon being heated by the heater component,
wherein the oxygen producing component is configured to release an oxygen containing vapor that mixes with the vapor to produce a mixed vapor upon being heated by the heater component,
wherein the oxygen containing vapor comprises at least 50% oxygen by weight, and
wherein the mixed vapor is released from the outlet of the e-vaping apparatus in response to a detected inhalation event at the outlet.

8. The e-vaping apparatus of claim 7, wherein the pre-vapor composition is inserted near the first end of the channel e-vaping apparatus.

9. The e-vaping apparatus of claim 7, wherein the pre-vapor composition is porous.

10. The e-vaping apparatus of claim 7, wherein the oxygen producing component is inserted near the second end of the channel e-vaping apparatus.

11. The e-vaping apparatus of claim 7, wherein the heater component is positioned in proximity to the pre-vapor composition and the oxygen producing component.

12. A method of providing oxygen in a vapor produced by an e-vaping apparatus, the method comprising:
detecting an inhalation action at a first end of the e-vaping apparatus of claim 1;
turning on a heater component to heat a channel within a cartridge,
wherein the channel includes a pre-vapor composition and an oxygen producing component;
producing a vapor in response to an application of heat by the heater on the pre-vapor composition; and
releasing oxygen into the vapor in response to the application of heat by the heater on the oxygen producing component.

13. The e-vaping apparatus of claim 1, wherein the pre-vapor composition is configured to release a vapor upon being heated by the heater component, and wherein the oxygen producing component is configured to release the oxygen containing vapor upon being heated by the heater component.

14. The e-vaping apparatus of claim 13, wherein the pre-vapor composition is inserted near the first end of the e-vapor apparatus.

15. The e-vaping apparatus of claim 13, wherein the pre-vapor composition is porous.

16. The e-vaping apparatus of claim 13, wherein the oxygen producing component is inserted near the second end of the e-vaping apparatus.

17. The e-vaping apparatus of claim 13, wherein the heater component is positioned in proximity to the pre-vapor composition and the oxygen producing component.

18. The e-vaping apparatus of claim 13, wherein the vapor and oxygen containing vapor are configured to mix before exiting the e-vaping apparatus at the outlet.

* * * * *